United States Patent [19]

DuFour

[11] Patent Number: 4,666,073

[45] Date of Patent: May 19, 1987

[54] SPRING BIASED SPOOL TYPE VALVE CONTROLLER FOR A PNEUMATIC DUAL DIAPHRAGM CONTROL SYSTEM

[76] Inventor: Kenneth S. DuFour, 1700 Phillips Dr., Sanford, N.C. 27330

[21] Appl. No.: 750,024

[22] Filed: Jul. 1, 1985

Related U.S. Application Data

[62] Division of Ser. No. 634,384, Jul. 25, 1984, abandoned.

[51] Int. Cl.[4] ..... B65H 23/04; F15B 9/10; F15B 13/02

[52] U.S. Cl. ..... 226/23; 91/368; 91/534; 92/39; 137/625.68; 226/1; 226/15; 226/180

[58] Field of Search ..... 226/1, 7, 21, 15, 23, 226/22, 180; 91/368, 47, 534; 92/39; 137/625.68

[56] References Cited

U.S. PATENT DOCUMENTS

| | | | |
|---|---|---|---|
| 2,796,851 | 6/1957 | Ziskal | 137/625.68 X |
| 3,009,364 | 11/1961 | Beachler | 226/23 X |
| 3,043,153 | 7/1962 | Hindle et al. | 226/23 X |
| 3,051,363 | 8/1962 | Brown | 226/23 |
| 3,071,157 | 1/1963 | Robertson et al. | 226/23 X |
| 3,101,005 | 8/1963 | Mittag | 226/21 X |
| 3,618,984 | 11/1971 | Cook | 137/625.68 X |

*Primary Examiner*—Stuart S. Levy
*Assistant Examiner*—Lynn M. Sohacki
*Attorney, Agent, or Firm*—Mills & Coats

[57] ABSTRACT

The invention relates to a direct acting pneumatic control system for controlling a dual diaphragm, or double acting cylinder type automatic guiding system. The control device and system is used to selectively adjust the position of one end of a roll relative to the opposite end, in order to adjust the position of an endless web traveling over a series of rolls.

In order to adjust and control the guide roll position, it is necessary to alternately exhaust one diaphragm, and or cylinder end, while maintaining the flow of air to the opposite diaphragm or cylinder end. This in effect shifts the roll in a lateral position, effectively steering the web in the proper direction to effect the necessary web correction.

To activate and control the valve position, the control valve is equipped with a palm which follows the web and continually monitors the web position and activates the control valve spool to modulate the "flow-exhaust" rates to bring the web to a corrected position with no over-run or "hunting" for position. The palm and its associated rod must follow the web when the web is moving away from the palm.

10 Claims, 11 Drawing Figures

SPRING BIASED SPOOL TYPE VALVE CONTROLLER FOR A PNEUMATIC DUAL DIAPHRAGM CONTROL SYSTEM

This is a division of U.S. patent application Ser. No. 634,384 now abandoned, filed July 25, 1984, and entitled "SPOOL TYPE VALVE CONTROLLER FOR A PNEUMATIC DUAL DIAPHRAGM CONTROL SYSTEM."

FIELD OF INVENTION

The present invention relates to a control valve to continually monitor and control a guide roll position and to effectively cause this guide roll to be moved in the necessary direction to maintain an endless web traveling in a straight run around a series of rolls.

SUMMARY AND OBJECTS OF INVENTION

The present invention presents a spool type pneumatic controller valve that operates within a 35 to 75 psi input range and feeds this output pressure directly to a guide mechanism to accomplish necessary corrections. The controller valve of the present invention is unique in that it is not a pilot device but handles full flow directly to the diaphragms and/or cylinder end without the benefit of additional linkage, mechanism, or pneumatic boosters.

The control valve of the present invention is designed to control a guide roll very precisely and this is accomplished through the particular design of porting within the valve. The "dead zone" area of "no correction" at the palm's neutral position is approximately one-eighth inch. This porting design and arrangement was designed and developed to give fast and accurate response even at the low range of inlet pressure operation of 30–35 psi, and to maintain any correction to the guide roll position until an additional correction is called for as a result of a change in the position of the web or material being guided and controlled. This unique design feature of the valve controller eliminates the "hunting" characteristic usually associated with such guide valves. This design feature within the controller valve is possible because of the relatively small movement of the spool within the valve body compared to web movement. The present spool design and the large ratio of palm movement to spool movement makes the valve sensitive and responsive to small changes in web position.

It is, therefore, an object of the present invention to provide a spool valve for a fluidic guiding system of the type that controls the running angle of material passing over a guide roll that overcomes many of the disadvantages and drawbacks of conventional control systems.

A further object of the present invention is to provide a control valve for a fluidic guiding system of the character referred to above which is simple in construction, includes relatively few moving parts, is reliable, and which requires little or no maintenance.

It is also an object of the present invention to provide a spool type control valve for a web guide roll guiding system that accurately and precisely responds to the movement of the web or other material passing over the guide roll.

Another object of the present invention resides in the provision of a spool type control valve for such a guiding system which includes a pivot arm directly operating the sliding spool which is responsive to lateral movement of material passing over the guide roll for actuating the spool accordingly so as to vary and control the running angle of the material passing over the same guide roll.

A further object of the present invention resides in the provision of a spool type control valve for a guiding system that is relatively inexpensive, but which is rugged in construction.

It is also an object of the present invention to provide a spool type control valve for controlling a web guiding system of the character referred to above which requires no adjustments and whose operation is not subject to temperature changes.

Still a further object of the present invention resides in the provision of a spool type control valve for a web guiding system of the character referred to above which is applicable and can be used with all web guiding applications.

A further object of the present invention resides in the provision of a spool type control valve for a web guiding system that requires no air supply treatment due to the relatively large orifices utilized.

Another object of the present invention resides in the provision of a web guiding system control valve which includes a universal mounting that enables the same to be mounted either right handed or left handed and which can be conveniently located remotely from the guiding system.

Another object of the present invention resides in the provision of a web guiding system spool type control valve that can be used on single diaphragm spring return type guiding systems by simply plugging one outlet port.

Still a further object of the present invention resides in the provision of a web guiding control valve that includes a following arm and palm that is biased to continuously monitor an edge of material passing over a guide roll wherein the pressure exerted against the guide arm, in order to maintain the same in a contact relationship, is of a relatively low pressure.

Another object of the present invention resides in the provision of a spool type control valve for a web guiding system that is completely enclosed so as to prevent contamination.

Finally it is an object of the present invention to provide a web guiding system control valve that is very compact.

It is also an object of the present invention to provide a spool type control valve of the character referred to above wherein the spool thereof is biased towards one extreme position by an enclosed helical spring.

Other objects and advantages of the present invention will become apparent from a study of the following description and the accompanying drawings which are merely illustrative of such invention.

DESCRIPTION OF INVENTION

Figure 1:
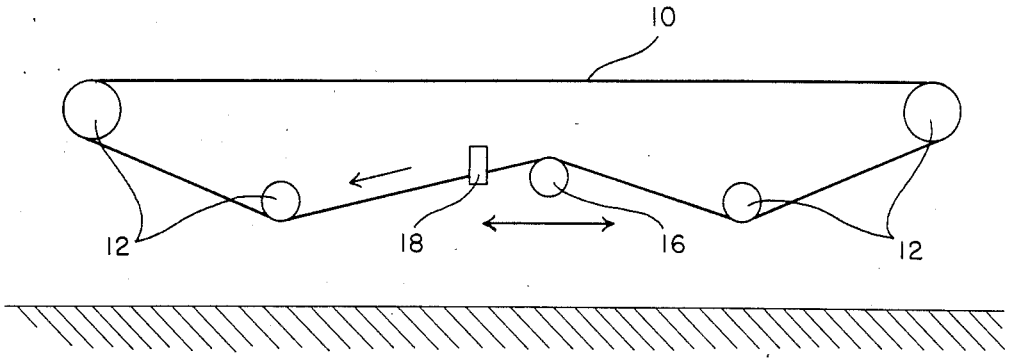
FIG. 1 is a side view illustration of an endless web passing around a series of rollers including a guide roller.

With further reference to the drawings, reference is made to FIGS. 1, 2*a*, 2*b* and 2*c* in order to illustrate the manner of maintaining proper running alignment of an endless web. In FIG. 1 an endless web 10 is shown passing around a series of carrier rolls 12. A guide roll, indicated by the numeral 16, is provided, and as seen in FIG. 1, web 10 travels thereover. In addition a palm or guide arm 18 is illustrated in FIG. 1. Palm or follower 18, as will be understood from subsequent portions of this disclosure, is utilized in conjunction with a control system that is responsive to lateral or side-to-side movement of the web 10 for appropriately correcting and controlling the running alignment of the web 10.

Figures 2A, 2B, 2C:
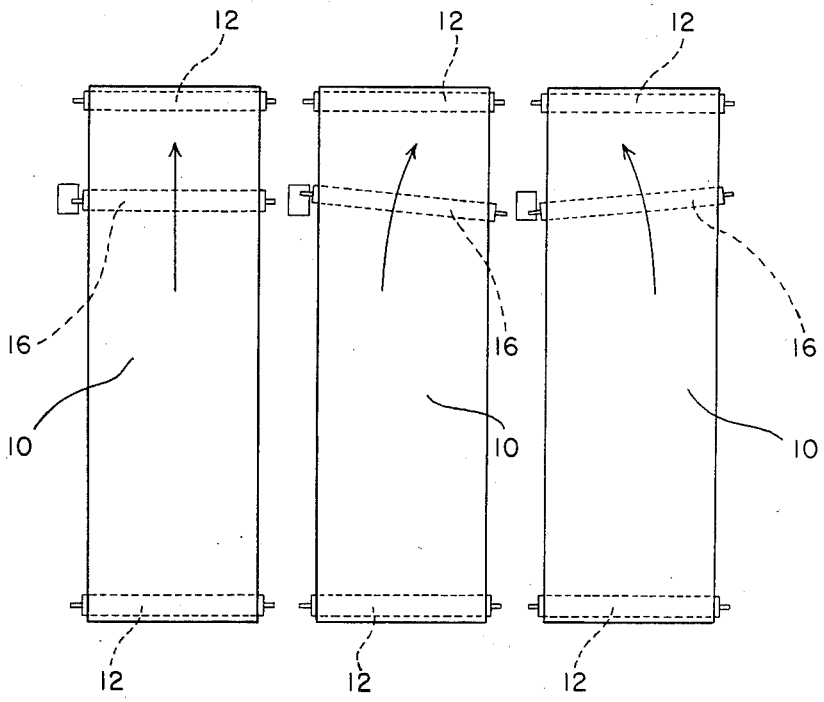
FIGS. 2*a*, 2*b* and 2*c* are top plan views of three separate web arrangements similar to that shown in FIG. 1 wherein in each of the three cases the guide roller is shown in a particular position to illustrate the natural direction that the web tends to follow as a result of the particular positioning of one end of the guide roller.

In FIG. 2*a*, the position of guide rolls 16 results in the web 10 moving in the direction of the arrow shown therein. By moving one end of guide roll 16 to the position shown in FIG. 2*b* causes the web 10 to move generally in the direction of the arrow shown therein. By moving guide roll 16 to the position shown in FIG. 2*c* results in the web 10 moving in the direction of the arrow as shown therein.

Therefore, in the case of an endless web 10, it is desirable to continually sense the position of the edge of the web with a palm or follower 18 (as illustrated in FIG. 1) and in response to that position to adjust by moving the ends of guide roll 16 so as to appropriately control and correct the alignment of the web 10.

Figure 3:
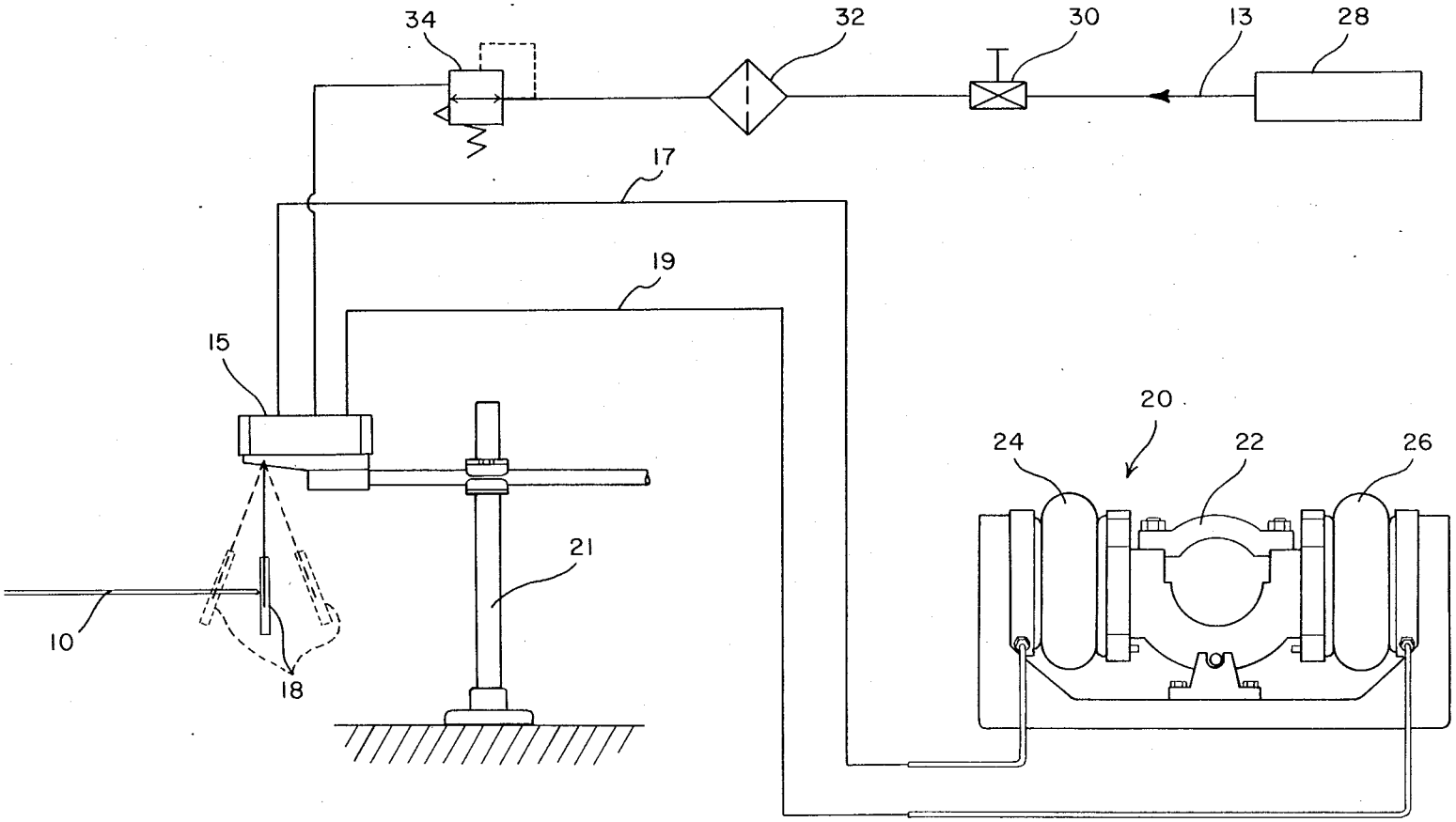
FIG. 3 is a schematic illustration of the guide roll system, control valve, and associated plumbing for directing air to and through the control valve and into the guide roll control system.

Now turning to FIG. 3, an actuator or guide system for moving guide roll 16 back and forth is shown therein, and indicated generally by the numeral 20. Actuator 20 is of a conventional design, and includes a saddle bearing holder 22 that is designed to receive an end bearing assembly of guide roll 16. Disposed on each side of saddle bearing holder 22 is a pair of diaphragms 24 and 26. It is appreciated that by inflating and deflating the respective diaphragms 24 and 26, that saddle bearing holder 22, and accordingly guide roll 16, can be moved back and forth. It is this back-and-forth control movement that results in the continuous control of the alignment of web 10.

The present invention particularly relates to a control valve, indicated generally by the numeral 15, for controlling actuator 20 and the respective diaphragms 24 and 26 thereof. Details of the control valve will be specifically dealt with subsequently herein. Prior to looking and viewing at the details of controller valve 15, a general discussion of the air flow to the control valve and to and from the actuator 20 will be dealt with.

In this regard, reference is made to FIG. 3. Therein an air supply indicated by the numeral 28 is provided. Air from the air supply 28 is directed through an inlet line 13 to a particular inlet port of the control valve 15. Air passing through line 13 will pass through an on-off valve 30, filter 32 and a pressure regulator 34.

Control valve 15 is mounted adjacent the traveling web 10 by a universal support structure 21. As will be discussed in more detail subsequently herein, control valve 15 includes a palm or follower 18 that continuously monitors the edge of web 10 and responds to the lateral movement thereof so as to continuously vary the output flow from control valve 15. Note in FIG. 3 that control valve 15 further includes two additional ports that again will be discussed in more detail subsequently herein. These two ports are operatively connected to diaphragms 24 and 26 via lines 17 and 19.

Figures 4, 5:
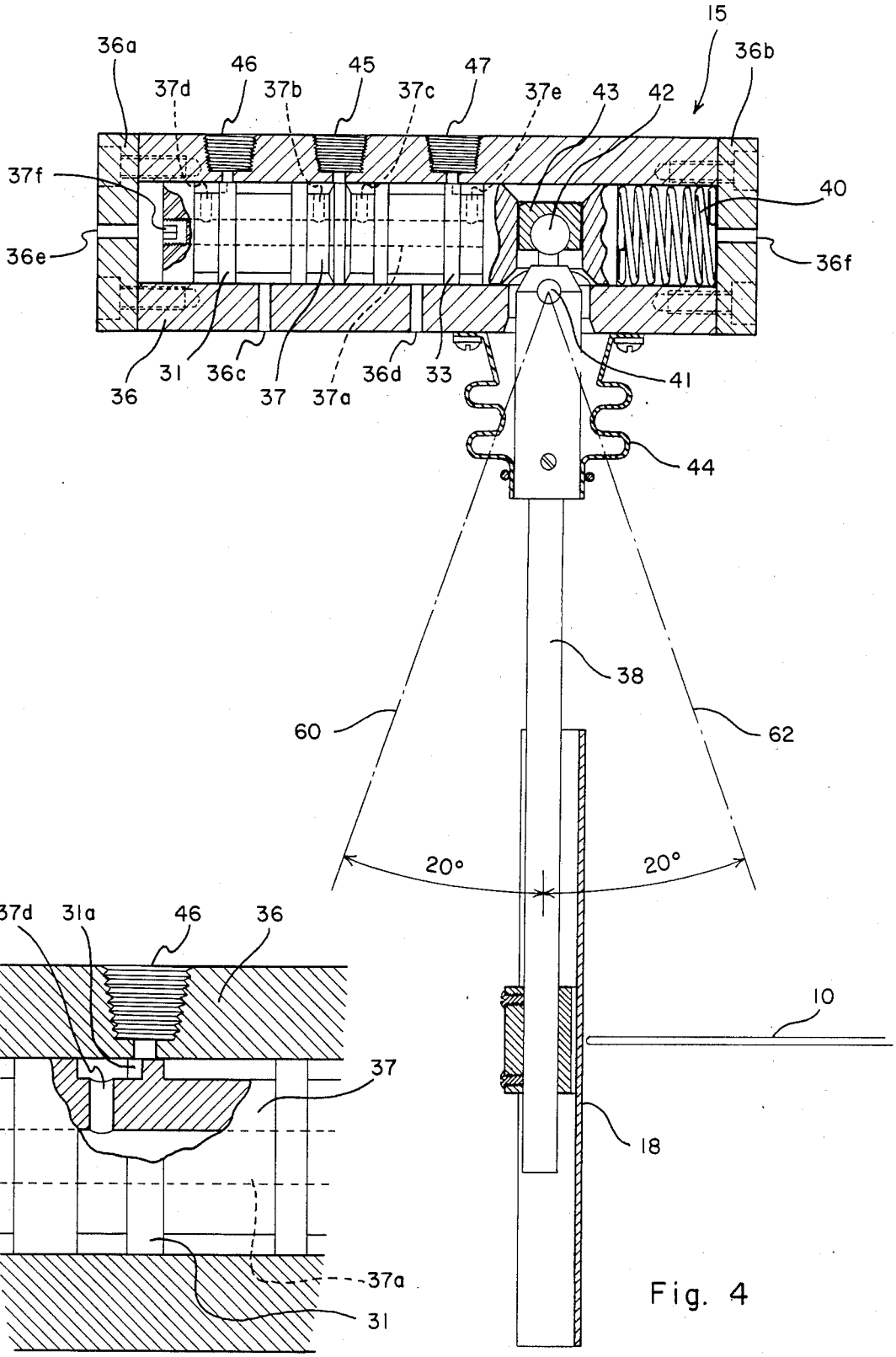
FIG. 4 is a sectional view illustrating the spool type controller of the present invention with the spool being shown in a neutral position.
FIG. 5 is an enlarged sectional view showing a selected portion of the valve and its spool with the spool being in the neutral position.

Turning to FIG. 4, there is shown therein a spool type valve controller, indicated generally by the numeral 15. Control valve 15 comprises a housing structure or valve body 36 which includes a sliding spool 37. Valve 15 further includes a pair of end covers 36*a* and 36*b*. End covers 36*a* and 36*b* are secured to valve body 36 forming a closed chamber within which spool 37 operates and wherein spool 37 is designed to move laterally back and forth therein in a shifting fashion.

Disposed within one end of the valve body, within a cavity formed, is a helical spring 40 that bears against one end of the spool 37 and is engaged about an opposite end by end cover 36*b*. Sufficient spring thrust is available to bias spool 37 towards the left as viewed in FIG. 4 causing palm 18 to follow the web 10.

Continuing to refer to FIG. 4, a rod 38 extends from pivot arm 42 which is pivotably mounted to valve body 36 through a pivot pin 41. Pivot arm 42 extends inwardly into the valve 36 and is connected to ball cap 43 that is confined within the spool 37. Ball cap 43 is capable of transverse movement within the valve 15 as pivot arm 42 is swung back and forth about pivot pin 41. In particular, ball cap 43 can slide or move up and down as viewed in FIG. 4 in a transverse direction to the longitudinal axis of spool 37. Thus it is appreciated that the movement of rod 38 allows the rotary motion of pivot arm 42 to be converted to sliding motion between ball cap 43 and spool 37. Secured to valve 36 and extending therefrom around pivot arm 42 is a bellows 44 that is provided to protect the interior of the valve 15 from exterior contaminants.

Formed in valve housing 36 is an inlet air port 45, two outlet ports 46 and 47, and two exhaust ports 36*c* and 36*d*. Vent holes 36*e* and 36*f* vent the valve housing to prevent any pressure build-up from spool movement as well as that occurring from leakage past spool 37.

In order to direct inlet air from inlet air port 45 to various areas of the valve 15, spool 37 is selectively drilled. In this regard, there is provided ports 37*b* and 37*c* which are drilled from the exterior of spool 37 to a central longitudinal port 37*a*. In addition, as shown in FIG. 4, there are two additional ports, 37*d* and 37*e*, that are formed in spool 37 and which extend from 37*a* outwardly therefrom to and through the side of spool 37. Central port 37*a* is terminated about the left end of spool 37 by a plug 37*f*.

Also as shown in FIG. 4, it is seen that spool 37 includes a series of selected raised shoulders that are utilized to control and direct the flow of air through the valve when spool 37 is disposed in various positions within the valve. Attention is directed to raised shoulders 31 and 33 that generally control the flow of air to outlet ports 46 and 47. Note that each of the raised shoulders 31 and 33 includes a notched area referred to as 31*a* in FIG. 5. These notched areas allow for continuous pressure to be exposed to ports 46 and 47 when the valve 15 assumes a neutral position. This will effectively exert a constant pressure against both diaphragms 24 and 26 of the actuator 20. As will be eluded to subsequently herein, this eliminates the undesirable characteristic known as "hunting".

With further reference to FIG. 4, it is seen that a palm 18 is secured to rod 38, and in an operative mode, palm 18 engages the side of web 10. Control valve 15 and palm 18 as shown in FIG. 4 is disposed in the first or neutral position. In this neutral position, inlet port 45 is open to spool ports 37*a*, 37*b*, 37*c*, 37*d* and 37*e*. Also in this first or neutral position, both outlet ports 46 and 47 are slightly open to inlet pressure, again as illustrated in FIG. 5. This effectively holds the guide in a neutral position until an additional correction is called for by the movement of palm 18. Exhaust ports 36*c* and 36*d* are closed.

In FIG. 4, there is shown two construction lines 60 and 62. Construction line 60 represents the position of palm 18 and rod 38 when it assumes what is referred to as "palm position No. 2". Construction line 62 represents what is referred to as "palm position No. 3".

In palm position No. 2, it is seen that the rod and palm will move from the neutral position a maximum of twenty degrees. In position No. 2, inlet port 45 is open to outlet port 46 through port 37*b*, 37*a* and 37*d*. Exhaust port 36*c* is blocked. In position No. 2, port 47 is effectively open to exhaust 36*d*. Consequently, air flow from a respective diaphragm of actuator 20 can be exhausted from exhaust 36*d* via port 47.

In palm position No. 3, illustrated by construction line 62, here again rod 38 and palm 18 assume position of approximately 20 degrees maximum from the neutral position. In position No. 3, inlet port 45 is open to port 47 through ports 37*c*, 37*a* and 37*e*. Exhaust port 36*d* is blocked. Port 46 is open to exhaust port 36*c*. Therefore, air from a respective diaphragm of actuator 20 that is connected to port 46 can be exhausted to exhaust port 36*c*.

Figure 6:
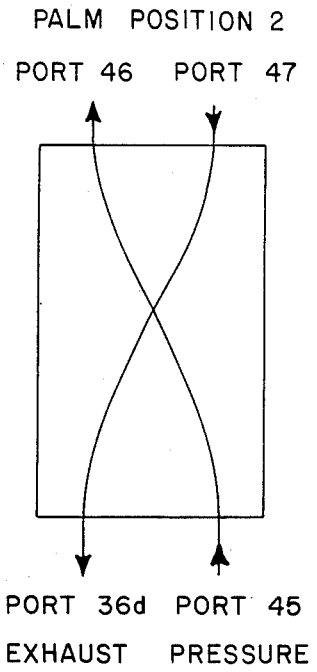
FIG. 6 is a schematic illustration of the control valve of the present invention illustrating the flow of air therethrough when the palm of the control valve as shown in FIG. 4 assumes the leftmost extreme position (position No. 2).
Figure 7:
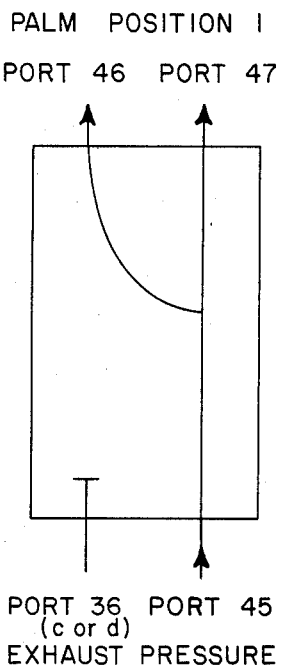
FIG. 7 is a schematic illustration of the control valve of the present invention illustrating the flow of air therethrough when the palm of the control valve as shown in FIG. 4 assumes the neutral position (position No. 1).
Figure 8:
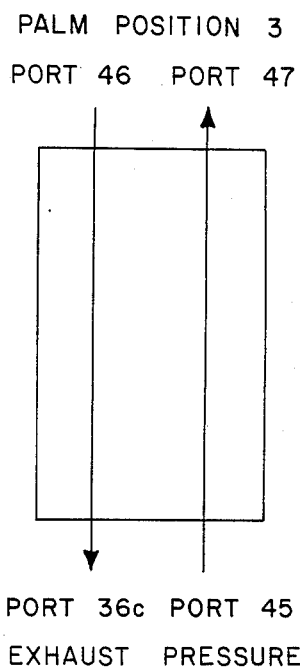
FIG. 8 is a schematic illustration of the control valve of the present invention illustrating the flow of air therethrough when the palm of the control valve as shown in FIG. 4 assumes the rightmost extreme position (position No. 3).

In FIGS. 6, 7 and 8, the flow of air through valve 15 is illustrated in each of the three positions just described. In FIG. 6, palm position No. 2 (construction line 60) is illustrated. In FIG. 7, the neutral position is illustrated. FIG. 8 illustrates the third palm position or the position occupied by the palm 18 when the same assumes that position represented by construction line 62 in FIG. 4.

It is appreciated that as palm 18 moves slightly from the neutral position towards palm position No. 2 that outlet port 46 becomes increasingly exposed to inlet pressure and outlet port 47 becomes increasingly exposed to exhaust port 36*d*. For minor corrections to the web 10 position, the flow rates are low and the corresponding speed of correction is slow. This eliminates overreaction and consequently "hunting" of the guide roll 12. Essentially the flow to the respective diaphragms 24 or 26 or to a cylinder end is proportional to the displacement of palm 18 toward either palm positions No. 2 or No. 3 relative to the neutral position.

The opposite conditions exist and prevail when palm 18 moves from the neutral position towards palm position No. 3. That is, outlet port 47 becomes increasingly open to inlet pressure and outlet port 46 becomes increasingly exposed to exhaust port 36*c*. Again the flows are proportional to spool displacement.

It is appreciated that helical spring 40 in bearing against spool 37 supplies sufficient force and pressure to assure that palm 18 continuously follows an adjacent edge of web 10.

Figure 9:
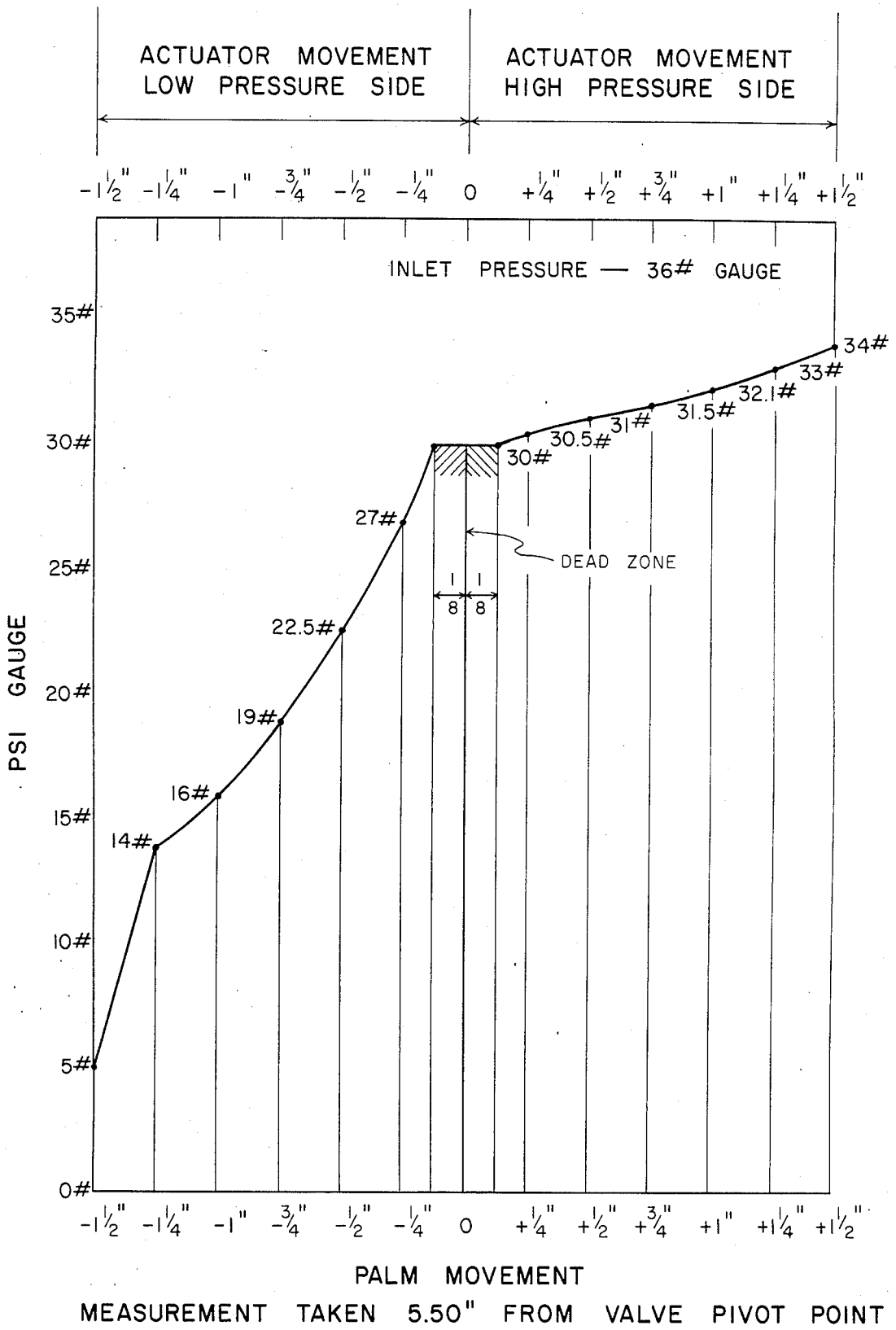
FIG. 9 is a graph illustration showing pressure measurements for various palm movements of the control valve of the present invention.

FIG. 9 displays a graph of actual diaphragm pressures plotted from the zero or neutral position of the actuator or guide roll carrier. These pressures are given for each 0.25" of palm movement, and illustrate the gradual and relatively straight line increase in pressure on the high pressure side and the corresponding decrease in pressure on the exhaust or low pressure side.

The gradual increase in force on the high pressure side results in a very uniform speed of movement, and provides precise control of the guide roll through the entire range of movement.

Reversal of high pressure and low pressure sides would result in a mirror image of the graph.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A sliding spool type controller assembly for controlling and directing air from an air source to a pneumatic guiding mechanis:m that is operatively connected to a guide roll for moving and adjusting the guide roll so as to appropriately guide a web material over the guide roll, comprising:

A. a spool type valve having a body, a sliding spool movably mounted for back and forth movement along its longitudinal axis therein, an air inlet port, outlet ports, and exhaust ports formed therein with the outlet ports being adapted to be communicatively connected to the pneumatic guiding system;

B. biasing means operatively associated with the spool for biasing the same toward a selected position within the valve;

C. spool actuating means for engaging an edge of the material passing over the guide roll and moving the spool back and forth within the valve in response to the lateral shifting of the material as the same passes over the guide roll wherein the movement of the spool, as a result of the lateral movement of the material, results in the guiding system adjusting the position of the guide roll so as to adjust the running angle of the material passing over the guide roll;

D. the spool actuating means including pivot arm means, directly coupled to said spool, for moving and shifting the spool back and forth within the valve in response to the lateral shifting of the material passing over the guide roll;

E. the spool and pivot arm adapted to assume a first neutral position and wherein from the neutral position the pivot arm may pivot to second and third extreme positions on opposite sides of the neutral position;

F. the valve and spool including means for opening the outlet ports and exposing the same to air pressure while closing the exhaust ports in response to the spool and pivot arm assuming the neutral position, thereby preventing the valve from experiencing "hunting"; and G. wherein the spool includes an airflow channel formed therein for directing air from the air inlet port of the valve, through the spool body onto the outlet ports of the valve, the air flow channel including an inlet air spool port formed in the spool for directing inlet air from the air inlet port of the valve into the spool, spool outlet ports formed in the spool for directing air passing through the spool to the outlet ports of the valve, and an air passage channel extending through the spool and between the inlet air spool ports and the spool outlet ports.

2. The spool type controller of claim 1 wherein said biasing neans includes a helical spring disposed within said valve body and disposed adjacent said spool so as to engage said spool and to bias the same in a selected direction.

3. The spool type controller of claim 1 wherein the pivot means includes a joint assembly operatively interconnected between the spool and the pivot arm means.

4. The spool type controller of claim 3 wherein said joint assembly includes a cavity actually formed in said spool and an opening providing access thereto, and a movable member contained within said cavity and operatively connected to said pivot arm means such that as said pivot arm is moved back and forth said spool is moved back and forth with said valve via said joint assembly converting rotary to sliding motion.

5. The spool type controller of claim 4 wherein said joint assembly is movable transversely in a direction normal to the longitudinal axis of said spool as said pivot arm means is moved back and forth.

6. The spool type controller of claim 5 further including a pivot pin connecting said pivot arm means with said valve adjacent said joint assembly.

7. The spool type controller of claim 6 including a pivot arm opening formed in said valve through which said pivot arm means projects, and wherein there is provided a flexible boot secured to said valve adjacent said pivot arm opening and which encompasses a portion of said pivot arm extending from said valve.

8. A spool type controller assembly for controlling and directing air from an air source to either side of a dual diaphragm pneumatic guiding system that is operatively connected to a guide roll for moving and adjusting the guide roll so as to appropriately guide a web material over the guide roll, said spool type controller comprising:

A. a valve having a body, a spool movably mounted therein, an air inlet port, a pair of outlet ports, exhaust port means formed therein with each outlet port being adapted to be communicatively connected to a respective diaphragm of said pneumatic guiding system;

B. biasing means operatively associated with said spool for biasing the same toward a selected position within said valve;

C. spool actuating means for engaging an edge of said material passing over said guide roll and moving said spool back and forth within said valve in response to the lateral shifting of said material as the same passes over said guide roll wherein the movement of said spool, as a result of the lateral movement of said material, results in the guiding system adjusting the position of said guide roll so as to adjust the running angle of the material passing over said guide roll;

D. wherein said spool actuating means includes pivot arm means directly coupled to said spool for moving said spool back and forth within said valve as said pivot arm means is moved back and forth, said pivot arm means including an inner end movably mounted to said spool and extending therefrom and further including a remote end having a follower secured thereto for engaging the edge of said material passing over said guide roll, such that said pivot arm means actuates and moves said spool back and forth within said valve in response to the lateral shifting of the material passing over said guide roll;

E. wherein there is provided a movable member movably mounted within a cavity associated with said spool with said movable member being movable back and forth within said cavity and valve in a direction normal to the direction of movement of said spool, and wherein a pivot arm is pivotably mounted within said movable member and connected to the inner end of said pivot arm such that as said pivot arm moves back and forth said pivot arm pivots within said movable member causing said spool to be shifted back and forth while said movable member moves transversely to the normal direction of said spool;

F. said spool and pivot arm adapted to assume a first neutral position and wherein from said neutral position said pivot arm may pivot to second and third extreme positions on opposite sides of said neutral position; and G. wherein said valve and spool include means for opening said outlet ports and exposing the same to air pressure while closing said exhaust port means in response to said spool and pivot arm assuming said neutral position, thereby preventing the valve from experiencing "hunting".

9. The spool type controller of claim 1 where in the means for opening the outlet ports and exposing the same to air pressure when the spool assumes the neutral position includes a pair of outer raised shoulders formed on the spool. with each raised shoulder disposed adjacent a respective outlet port of the valve and movable back and forth thereacross to regulate the flow of air into the outlet ports of the valve; and wherein the pair of outer shoulders are particularly spaced such that in the neutral position the outlet ports of the valve are substantially blocked except for a relatively small opening adjacent to the respective outlet ports of the valve and an adjacent shoulder that allows constant air pressure to exist in both the outlet ports of the valve.

10. The spool type controller valve of claim 9 further including three additional shoulders formed intermediately on the spool between the outer shoulders, the three intermediate shoulders including a center shoulder movable back and forth across the inlet port of the valve for controlling the flow of inlet air into the valve, and an outlet air confining shoulder formed on each side of the center shoulder; and wherein there is a pair of inlet air spool ports formed in the spool between the center shoulder and the respective inlet air confining shoulders.

* * * * *